US005375289A

United States Patent [19]

Miyaoka

[11] Patent Number: 5,375,289

[45] Date of Patent: Dec. 27, 1994

[54] POLISHING BONNET

[75] Inventor: Atsushi Miyaoka, Tokyo, Japan

[73] Assignee: Chiyoda Mfg. Co., Ltd., Tokyo, Japan

[21] Appl. No.: 833,361

[22] Filed: Feb. 10, 1992

[30] Foreign Application Priority Data

Feb. 13, 1991 [JP] Japan ..... 3-011961[U]

[51] Int. Cl.[5] ..... B24B 29/00

[52] U.S. Cl. ..... 15/230; 15/230.12; 15/230.16; 51/395

[58] Field of Search ..... 15/230, 230.12, 207.1, 15/230.16; 51/395, 394, 400–402

[56] References Cited

U.S. PATENT DOCUMENTS

| | | | |
|---|---|---|---|
| 2,027,425 | 1/1936 | Hall | 15/230.16 |
| 3,346,904 | 10/1967 | Armstrong | 15/230.12 |
| 3,920,784 | 11/1975 | Nakagawa et al. | 264/168 |
| 4,715,150 | 12/1987 | Takeuchi et al. | 51/395 |
| 4,741,941 | 5/1988 | Englebert et al. | 15/209.1 |
| 4,788,798 | 12/1988 | DeFranco et al. | 51/395 |
| 4,888,229 | 12/1989 | Paley et al. | 15/209.1 |
| 4,945,687 | 8/1990 | Scheider et al. | 51/400 |
| 5,007,128 | 4/1991 | England et al. | 15/230.16 |

*Primary Examiner*—Timothy F. Simone
*Assistant Examiner*—Patrick Brinson
*Attorney, Agent, or Firm*—James J. Ralabate

[57] ABSTRACT

The cleaning and polishing pad of this invention has extremely fine microfibers ranging in thickness up to one denier. In addition, the microfibers have a polygon configuration which provides edges that enhance the cleaning ability of the fibers. The pad can be attached to the rotating disk of a polisher by a bolt extending through an aperture in the pad. Alternatively, the pad can fit over the rotating disk like a shower cap where an elastomeric band is provided around an inner opening of the pad.

4 Claims, 8 Drawing Sheets

POLISHING BONNET

This invention relates to a polishing bonnet or buffer and, more particularly, to a polishing disk, bonnet or pad having a unique configuration.

BACKGROUND OF THE INVENTION

Heretofore, polishing bonnets or buffers were not able to produce satisfactory buffing and polishing results due to the coarseness and configuration of the fibers which make up the polishing surface. These prior art fibers were lacking in fineness or delicacy of texture and also of structure to attain maximum results. Also, most prior art fibers used in polishing pads or disks have large circular cross sections which limit the fiber contact area to the surface to be polished. In addition, thicker prior art fibers in polishing disks have very limited capacity for absorbing water or other liquids. Thus, the speed of absorbing a liquid in prior art buffing disks is very slow.

When these prior art buffing disks are used to polish or buff painted surfaces of automobiles or other painted surfaces, most contain fibers made from unwoven or conventional fabrics which are not densely provided on the polishing surface. Therefore, because of lack of density of fibers, largeness of fiber cross-sectional areas, their general round fiber configuration and coarseness, prior art buffing disks do not effect maximum polishing potential. Most prior art fibers used in polishing pads have a round cross-sectional configuration without edges as any circular object.

SUMMARY OF THE INVENTION

It is therefore an object of this invention to provide a buffing disk devoid of the above-noted disadvantages.

Another object of this invention is to provide a buffing disk comprising a surface made up of fibers having diameters less than one denier.

A further object of this invention is to provide a novel microfiber polishing disk of increased fiber density on the polishing surface.

A still further object of this invention is to provide a polishing bonnet having fibers with a substantially polygon cross-section with edges to enhance polishing.

A yet further object of this invention is to provide a disk that will have an increased fiber contact area to the surface to be polished.

Yet still a further object of this invention is to provide a polishing disk having an increased liquid absorption capacity.

These and other objects of the invention are accomplished by providing a polishing disk having woven microfibers of under one denier. The term "microfiber or fibers" as used throughout the disclosure and claims is intended to mean a fiber of which the diameter is under 9,000 meter length per one gram or a fiber having a unit weight less than 0.05 gram per 450 meters. In a preferred embodiment of this invention woven microfibers are used that have a thickness less than one denier. The woven microfibers are positioned on the bottom polishing surface or first surface of an elastomeric disk. On the opposite top surface or second surface of the disk adjacent the polisher rotator is a bonding agent used to secure the disk to the polisher rotator or rotating disk. The microfibers of the polishing disk of this invention can be made from polyesters, acrylic, nylon, cotton, silk or any other suitable natural or synthetic fiber or mixtures thereof. The main body of the rubber-like disk of this invention has a circular configuration with a hole in the center for securing to the rotary of the polisher. On the top surface of the disk is positioned Velcro, tape, hook and loop fasteners or any other suitable attaching means to be used for securing the disk to a rotary disk of a polisher. On the bottom surface of the disk is the microfiber polishing face. The disk may be constructed of rubber, elastomers, or any other suitable resilient material. The microfibers may be substantially vertical, may be formed into loops or sheared of tips to form a moquette face. Around the periphery of the round disk is located a soft mounting material for preventing scratching of the surface to be polished.

The microfibers may have raised upright single strands, may be formed into loops such as by pile stitching, or may be sheared off at their loop ends so as to form a moquette.

When these disks are attached to the rotary or core disk holder of a polisher, the center aperture is used in alignment attachment to said rotary or core disk holder. A bolt or other means is used with a tightening means such as a wing nut to hold the disk in place. The microfibers can be positioned on the bottom face of the main body of the disk in a random fashion or can be positioned thereon in lines or stripes with spaces between each line of microfibers. The microfibers have a polygon cross-section so as to provide edges for better polishing. These edges are not present on most round cross-sectional prior art fibers. Since the microfibers of the present invention are so thin, there is provided thereby more clearance between each fiber to hold liquids, waxes, polishes, or other useful substances therein.

DESCRIPTION OF DRAWINGS AND PREFERRED EMBODIMENTS

Figure 1:
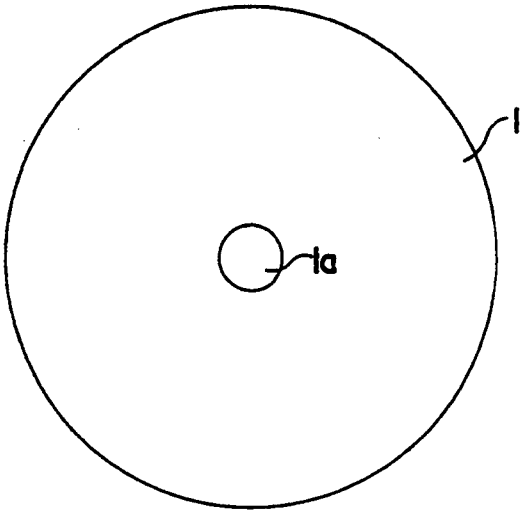
FIG. 1 is a top plan view of the main body of the polishing disk of this invention.
Figure 2:
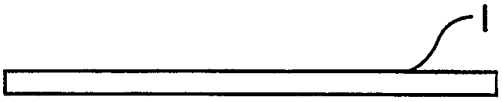
FIG. 2 is a side plan view of the main body of the polishing disk of this invention.
Figure 3:
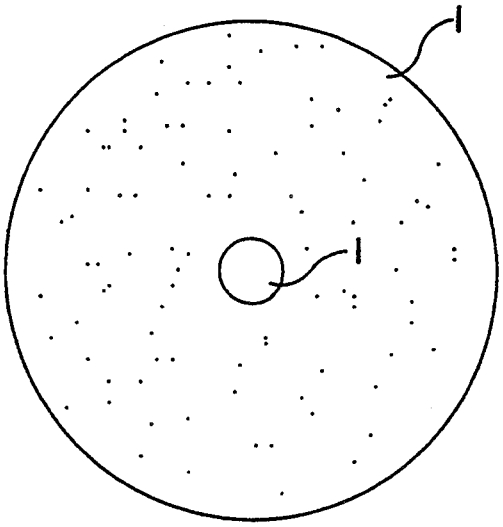
FIG. 3 is a top plan view of the center apertured bottom face of the polishing disk of this invention having the microfibers positioned thereon in a random fashion.
Figure 17:
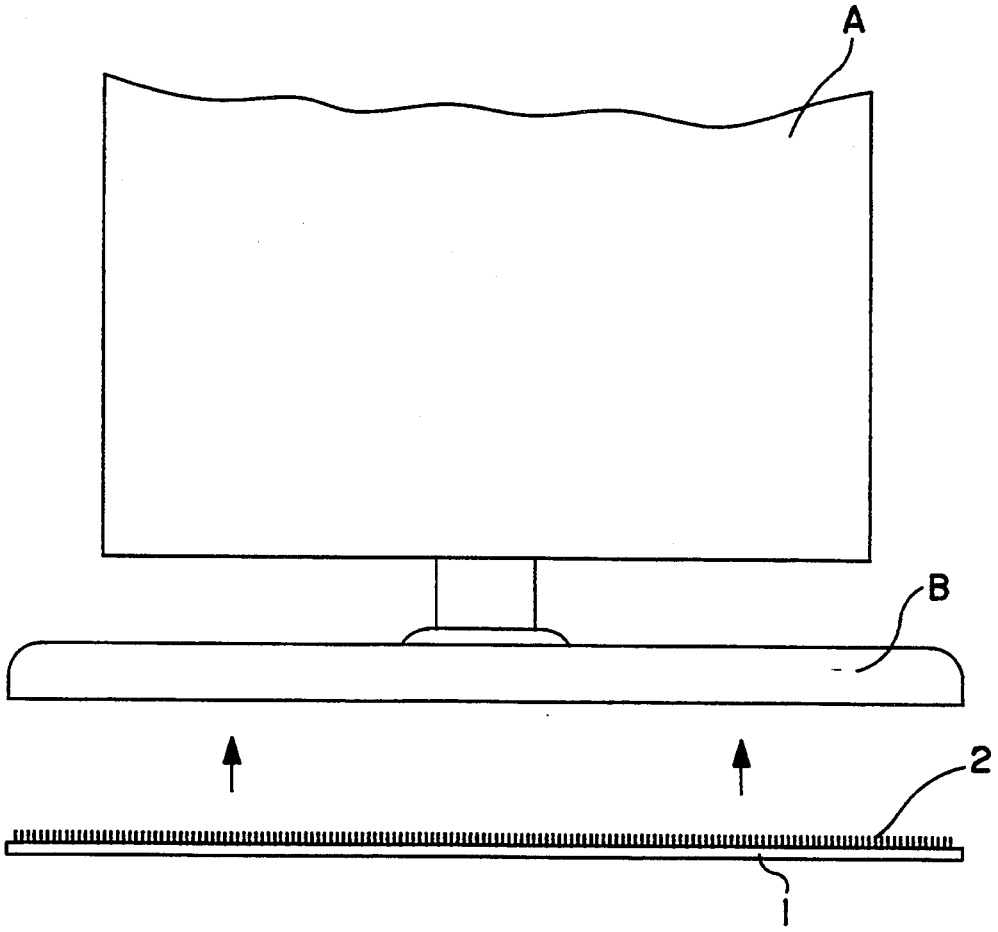
FIG. 17 is a side plan view of a rotary polisher having an exploded view of the disk of this invention before attachment to the rotary or core disk of a polisher mechanism.

In FIGS. 1–3 the bonnet or pad main body 1 is shown in a top, side and bottom view, respectively. In FIG. 1 the top face 13 of main body 1 is shown, positioned thereon is a bonding or attachment means (not shown in FIG. 1) such as Velcro, hook and loop type fasteners, or any other suitable means to connect main body 1 to the rotating disk B (of FIG. 17) of a polisher machine A. In the center of circular pad 1 is a hole 1A for connecting by nut and bolt or the like the pad 1 to the rotating disk 3 as shown in FIG. 17. In addition to use of aperture 1A to connect the pad 1 to the rotating disk 3, a layer of Velcro 2 or the like (in FIG. 17) is also used to firmly connect the pad 1 to the rotating disk B. In FIG. 2 a side plan view of the main body or pad I is illustrated having on the top face a layer of Velcro 2 (or other attaching means) and on the bottom face the layer of microfibers 13. In FIG. 3 the bottom face of pad 1 is shown with a layer of microfibers 13 on the bottom or lower face of pad 1.

Figure 4:
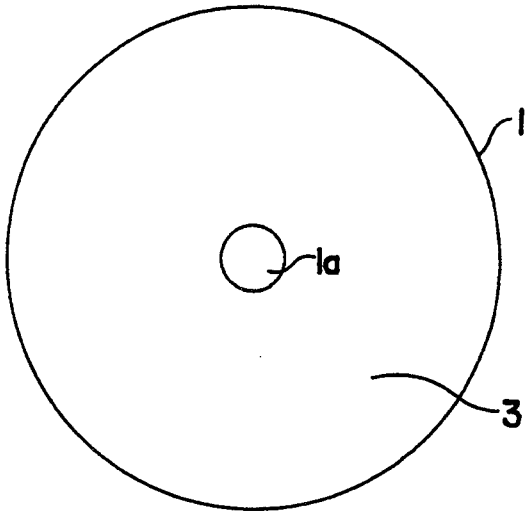
FIG. 4 is a top plan view of the rotary or core disk holder to which the microfiber disk is attached.
Figure 5:
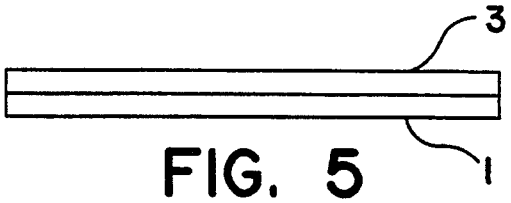
FIG. 5 is a side plan view of the main body of the microfiber disk as it is attached (by bolt or other means through center aperture) to the rotary or core disk holder.
Figure 6:
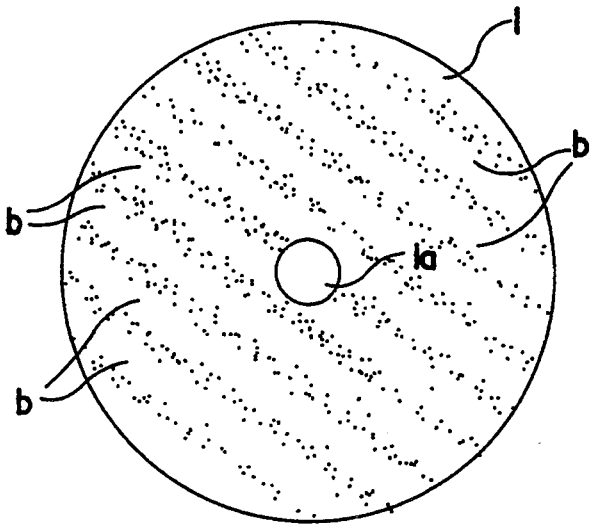
FIG. 6 is a top view of an embodiment of the bottom face of the microfiber disk wherein the fibers are positioned in alignment with spaces therebetween.
Figure 7:
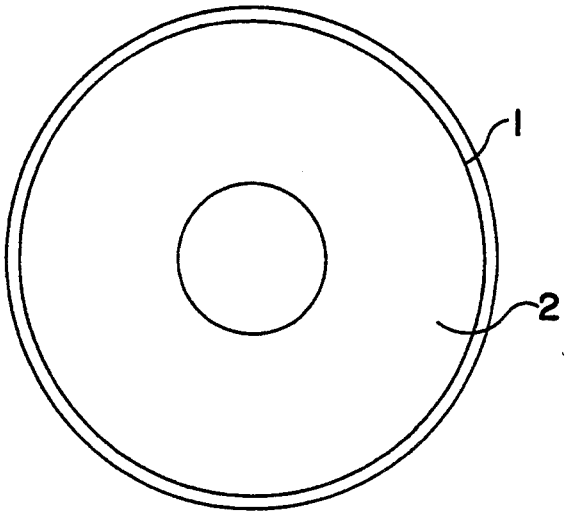
FIG. 7 is a top plan view of the top surface of the microfiber disk, said surface containing a bonding or securing means.
Figure 8:
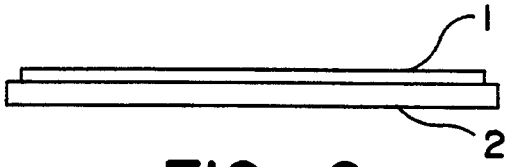
FIG. 8 is a side plan view of the main body of the microfiber disk having on its upper face a layer or portion of a bonding or securing means.
Figure 9:
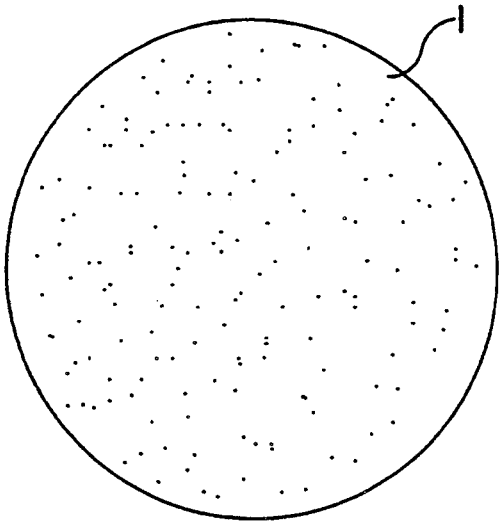
FIG. 9 is a top plan view of the upper face of the microfiber disk having a Velcro surface for attachment to the rotary or core holder of the polisher mechanism.
Figure 18:
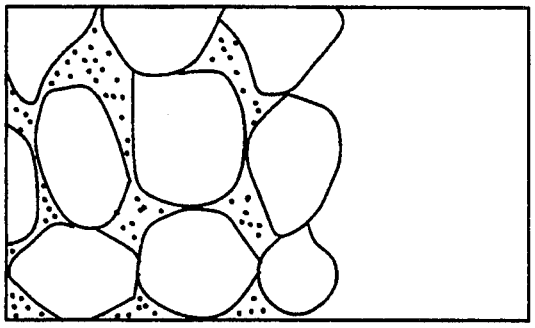
FIG. 18 is a cross-sectional view of the microfibers of this invention showing the density of the fiber population and the edges of the polygon cross sections.

In FIG. 4 the rotating or core disk 3 is shown from a top view and the main body 1 is designated as being below core disk 3 as clearly shown in FIG. 5. The hole 1A is in core disk 3 for attachment to polisher rotary cam 14 of polisher A as shown in FIG. 17. Main body 1 with a bottom face containing microfibers 13 is shown in FIG. 5. In FIG. 6 the bottom face of pad 1 with microfibers 13 is shown; in this embodiment the microfibers 13 are positioned in alignment with lines or stripes of fibers having space lines 15 therebetween. In FIGS. 7–9 a second embodiment of pad 1 is shown where the microfibers 13 are randomly arranged (FIG. 9) as opposed to fiber lines or stripes as in FIG. 6. Both embodiments will function properly but the arrangement of FIG. 6 is preferred for best results. The fibers of prior art polishing pads generally have a round cross-sectional configuration whereas it is critical to the present invention that edges be present on all the microfibers. The term "edges" as used throughout this disclosure and the claims means the corners or points 16 between sides of a polygon as shown in FIG. 18.

Figure 10:
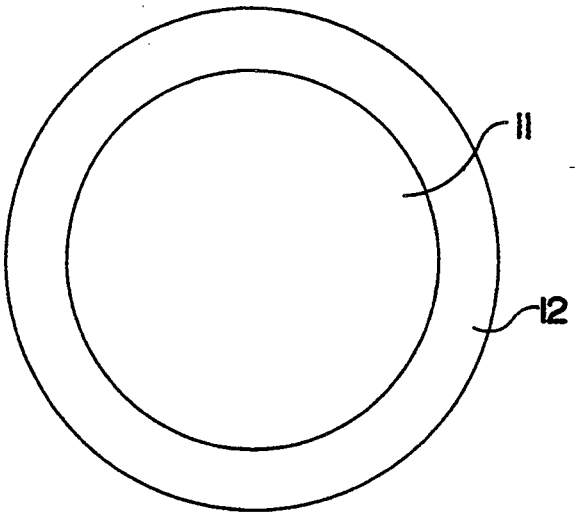
FIG. 10 is a top plan view of the top surface of the disk with the soft mounting material positioned around the periphery of the disk.
Figure 11:
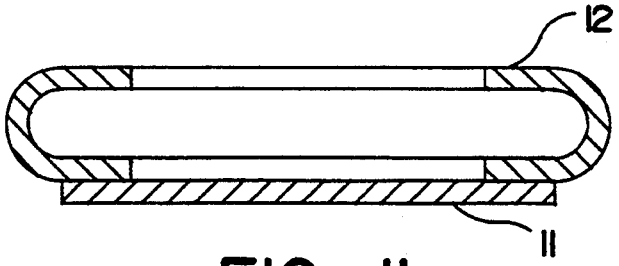
FIG. 11 is a side plan view of the disk showing the soft mounting material positioned around the periphery of the disk.
Figure 12:
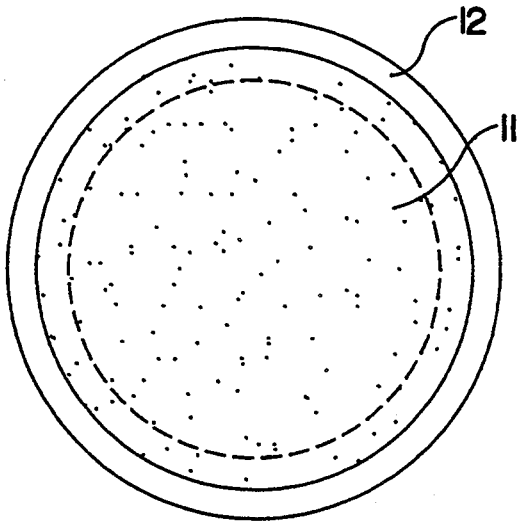
FIG. 12 is a top plan view of the bottom face of the disk with the microfibers positioned thereon.

In FIGS. 10–12 the top, side and bottom view of main body 1 is shown having an elastomeric rim or peripheral frame 12 around the circumference of main body 1. This rim 12 has an inner rubber band 20 which can be used to insert or wrap main body 1 around rotating disk 3. This holds main body 1 in place when in use rather than using a bolt through aperture 1A. When the rubber band 20 of FIGS. 7 and 10 are used the pad fits like a cap over rotating disk 3. The layer of Velcro 2 (or the like) is always positioned on the top face of pad 1 and the layer of microfibers 13 is always positioned on the bottom face of pad or main body 1. The pad 1 can have an aperture 1A, if desired, as shown in FIGS. 1–6 or can have a string or rubber band around its periphery for attachment to the rotating disk 3.

Figure 13:
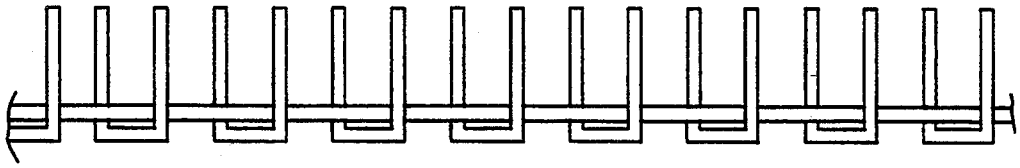
FIG. 13 is a plan view of the raised upright single microfiber materials useable in the present invention.
Figure 14:
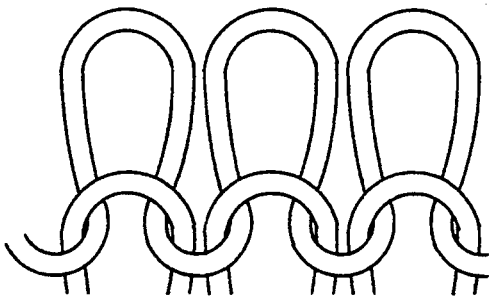
FIG. 14 is a plan view of the microfibers useable in this invention formed into loops.
Figure 15:
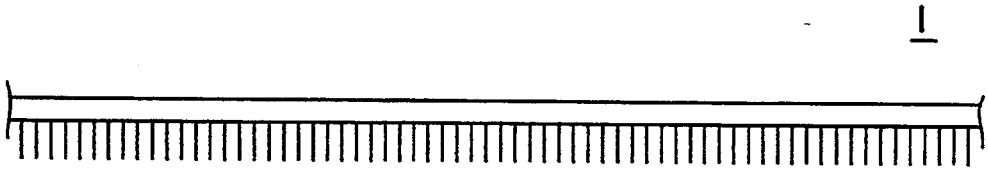
FIG. 15 is a side plan view of the disk of this invention with the exposed microfibers randomly dispersed on its bottom surface or face.
Figure 16:
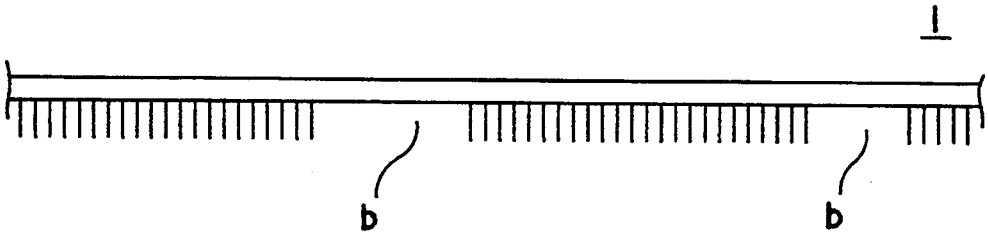
FIG. 16 is a side plan view of the disk of this invention with the exposed microfibers arranged in lines having spaces therebetween void of any fibers.

In FIG. 13 microfibers 13 of raised upright configuration are shown or alternatively microfibers 13 formed into loops as in FIG. 14 may be used. The microfibers 13 may be positioned randomly or otherwise throughout the lower surface of pad 1 as is shown in FIGS. 9 and 15 or may be positioned on the lower face in fiber lines with spaces 15 as shown in FIGS. 6 and 16. The embodiment of FIGS. 6 and 16 are preferred because spaces 15 permit heat generated during polishing friction to dissipate. Heat can cause the fibers 13 to collapse during use. But in either embodiment of FIG. 15 or 16 all microfibers must have edges 16 as shown in FIG. 18. This edge feature is critical to the present invention as is the fine below 1 denier thickness of each microfiber in microfiber layer 13.

In FIG. 17 a polisher A is illustrated having a turret or rotating cam 14 which is rotated or driven by any conventional means. Attached to turret 14 is a rotating disk 3 made of rubber or any other suitable material. This disk 3 has on its lower face a mate-attaching means 17 to the layer 2 of main body attaching means. If Velcro is used as layer 2, a mating layer 17 to the velcro is positioned at the bottom face of rotating disk 3. Circular pad main body 1 is attached to rotating disk 3 by the Velcro layer or any other suitable means and will rotate as rotating disk 3 rotates as caused by the power source of polisher A. The lower face of main body 1 which contains the microfibers 13 will then be ready to contact-polish a painted surface such as a car or the like.

FIG. 18 illustrates the polygon cross sectional of the microfibers 13 used in the present invention. These microfibers can be very thin such as in the order of 0.1 micron but the preferred thickness of each fiber should be less than one denier. The fibers can be made from 0.3 denier of 100% polyester or other suitable fabrics. It is critical to the present invention that the diameter of the microfibers used be less than one denier and each have a polygon shape to provide edge portions 16. The increased density of these microfibers 13 increases the rapid absorption of water, polish or other materials both liquid, pastes, solid powders or mixtures thereof. This rapid absorption is believed caused by the capillary tube phenomenon. The edges 16 of the polygon microfibers promote better cleaning and polishing of a painted or other surface to be cleaned and polished.

Figure 19:
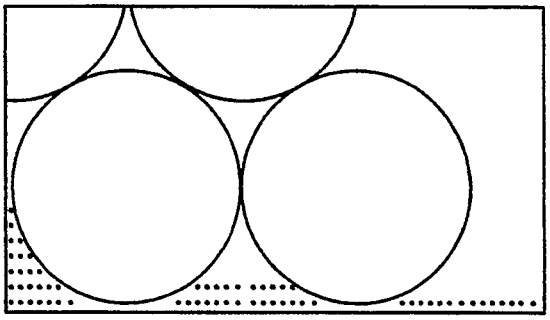
FIG. 19 PRIOR ART
FIG. 19 is a cross-sectional view of the prior art fibers used in buffing disks of conventional means which are round without edges or points.

FIG. 19 illustrates conventional thicker and round fibers heretofore used in items of this nature. There are no edges on these prior art round fibers 18. Also, because of the large spaces 19 in between each fiber, less liquid can be retained when in use, The preferred and optimumly preferred embodiments of the present invention have been described herein and shown in the accompanying drawings to illustrate the underlying principles of the invention, but it is to be understood that numerous modifications and ramifications may be made without departing from the spirit and scope of this invention.

What is claimed is:

1. A disk-like polishing pad comprising a main body having positioned on its upper face an attachment means, and on an opposite lower face a plurality of exposed microfibers, said microfibers each having a clearance therebetween and having a polygon shape with edge portions to form thereby a polishing disk of increased fiber density on said lower face, said edge portions providing means for improved cleaning and polishing, each microfiber having a diameter less than 1.0 denier and wherein said microfibers are dispersed on the lower face in stripes or lines with spaces therebetween.

2. The pad of claim 1 having microfibers that extend upwardly as single strands having clearance therebetween.

3. The pad of claim 1 having microfibers that extend upwardly to form a moquette face having clearances between each microfiber.

4. The pad of claim 1 wherein said microfibers are made from a material selected from the group consisting of polyester, acrylics, nylon, other synthetic materials, cotton, wool and mixtures thereof.

* * * * *